United States Patent [19]

Mansfield

[11] 4,188,717

[45] * Feb. 19, 1980

[54] APPARATUS AID

[76] Inventor: Henry T. Mansfield, P.O. Box 434, Barnwell, S.C. 29812

[ * ] Notice: The portion of the term of this patent subsequent to Dec. 27, 1994, has been disclaimed.

[21] Appl. No.: 843,449

[22] Filed: Oct. 19, 1977

[51] Int. Cl.[2] ..... B26B 21/40

[52] U.S. Cl. ..... 30/90

[58] Field of Search ..... 30/43, 90, 296 R; 248/176, 177, 187, 121, 122, 206 R, 316 R, 316 B, 316 C, 314, 362; 128/24 R; 269/45, 239; 248/363, 537, 230; 403/87

[56] References Cited

U.S. PATENT DOCUMENTS

| | | | |
|---|---|---|---|
| 562,887 | 6/1896 | Casler | 248/230 |
| 1,138,417 | 5/1915 | Rottenberg | 248/187 X |
| 1,538,340 | 5/1925 | La Hodny | 403/87 X |
| 1,809,774 | 6/1931 | Coates | 269/239 X |
| 2,085,651 | 6/1937 | Greve | 248/122 X |
| 2,329,891 | 9/1943 | Gantner | 30/90 |
| 2,489,845 | 11/1944 | Zedler | 248/363 X |
| 2,911,982 | 11/1959 | Guden | 248/122 X |
| 3,081,054 | 3/1963 | Westervelt | 248/537 |
| 3,276,734 | 10/1966 | Goldblatt | 248/176 |
| 3,399,675 | 9/1968 | Hill | 248/316 R |
| 3,750,991 | 8/1973 | Ragir | 248/206 R |

FOREIGN PATENT DOCUMENTS

| | | | |
|---|---|---|---|
| 531774 | 3/1921 | France | 248/230 |

*Primary Examiner*—Gary L. Smith

[57] ABSTRACT

A device is disclosed for use with an apparatus comprising a holding device operative to hold the apparatus and a stabilizing device operative to secure the holding device, the stabilizing device comprising a support piece and attaching pieces operative to attach the holding means to the suppport piece, the attaching piece comprising a base on a structure, a single continuous arcular piece, with an opening, emanating from the base and a void area between the end of the single continuous arcular piece and the base through which the support piece may be placed within the opening.

4 Claims, 4 Drawing Figures

APPARATUS AID

This invention relates to a functional apparatus aid and more particularly to an aid which can be utilized by a person without the use of his limbs.

Many persons, unfortunately, do not have full use of their limbs. Many diseases and injuries create handicaps which need to be overcome, if possible. The present invention specifically solves the problem of a man who would like to shave, but does not have full use of his limbs. By utilizing the present invention, the man can overcome his handicap with only a slight amount of help and enjoy the pleasure and accomplishment of shaving himself. Other functional equipment can also be similarly utilized by use of the present invention. This invention comprises material which has been previously disclosed in Mansfield U.S. Pat. No. 4,064,625.

An object of this invention is to provide a functional apparatus aid which can be utilized by a person who has limited or no use of his limbs.

Another object of this invention is to provide a functional apparatus aid which can be stabilized on various surfaces.

A further object of this invention is to provide a shaving aid for persons without use of their limbs that can be utilized at various angles by the person being shaved.

Another object of this invention is to provide a shaving aid that can be held by a man between his legs.

Another object of this invention is to provide a multiplicity of pressure points on a shaving aid, so that a man can have a good grip on the shaving aid when held between his legs.

Still another object of this invention is to provide a support device which can support various functional equipment which might then be utilized with limited or no use of the user's limbs.

Another object of this invention is to provide a remote switch for a shaving aid which would enable a person who has partial use of his limbs to control the on-off function of the shaver.

These and other objects and features of the invention will be apparent from the following description and appended claims.

Briefly, the invention is a device for use with a functional apparatus comprising holding means and stabilizing means. The functional apparatus may be utilized without being held in the hands of the user. The holding means comprises a structure containing an opening within which the functional apparatus may be held. The structure comprises a plurality of sides surrounding the opening and overlapping members comprises one of the plurality of sides. The holding means further comprises securing means, which may be a screw, operative to secure the functional apparatus in the opening. The screw may extend from one of the sides to another of the sides and operate to vary the amount of overlapping in the overlapping members, thereby tightening or loosening the pressure of the structure around the functional apparatus. The screw may extend through a second of the plurality of sides, and through a third side. The third side may have a built-up area with a threaded portion operative to receive the screw. The stabilizing means may comprise an extended portion of the structure which is operative to be held between the legs of the user. The extended portion of the structure may comprise two sides with each of the two sides having two edges with a void between. When the user holds the extended portion of the structure between his legs, the edge from each of the two sides may press against each leg of the user, providing greater stability. The stabilizing means may also comprise support means and attaching means operative to attach the device to the support means. The support means may comprise suction means operative to create a suction force on a surface and bar means attached to a suction means. The support means may further comprise a ring stabilizer, comprising a stabilizer ring and a plurality of stabilizing rods attached to the bar means. The bar means may comprise a vertical bar, a horizontal bar attached to the vertical bar, and a support bar which is the lower portion of the vertical bar. The plurality of stabilizing rods may be attached to the support bar. A support base may be secured to the bottom of the support bar. The suction means may comprise a suction cup, a suction release tab, and a suction cup top containing a threaded hole. The support base may contain a screw which is operative to be screwed into the threaded hole in the suction cup top. The support base and the suction cup top may have the same diameter. The diameter of the stabilizing ring may be greater than the diameter of the suction means. The stabilizing ring may be located so that when the suction means is pressed onto the surface, the stabilizing ring is close enough to the surface to stabilize and balance the device. The attaching means may comprise a base; an arcular piece, with an opening, emanating from said base; and fastening means operative to fasten the support means within the opening in the arcular piece. The diameter of the base means may be slightly less than the opening in the arcular piece. The base means, for example the horizontal bar or vertical bar, may fit into the opening and be secured by the fastening means. The fastening means may comprise a screw which extends from a portion of the arcular piece and presses against the bar means. The functional apparatus may be a shaver. The support means may be utilized to support any device for any desired function.

The invention will be more fully understood from the following detailed description and appended claims when taken with the drawings in which:

Figure 1:
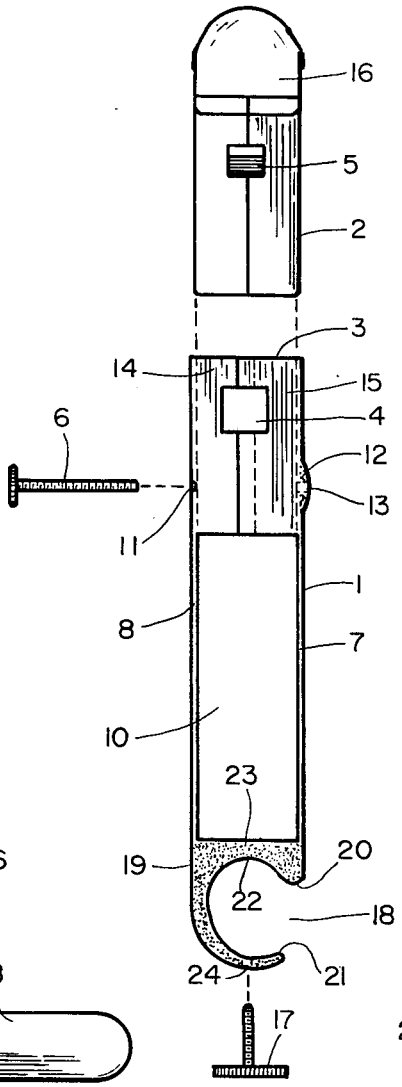
FIG. 1 is an exploded view of a functional apparatus which is a shaving aid 1 and shaver 2.

Referring now to the drawings, FIG. 1 shows an exploded view of a functional apparatus which is a shaving aid 1 and the shaver 2. The shaver 2 is shown with shaving head 16 and shaver switch 5 as in any ordinary electric shaver.

The shaver 2 may be inserted into the top opening 3 of the shaving aid 1, and then may be secured therein by the use of screw 6. Screw 6 is inserted through hole 11 into threaded hole 13 which is in the built-up area 12.

The functional apparatus, or shaving aid 1, comprises holding means operative to hold the functional apparatus and stabilizing means operative to secure the holding means in a stable position. The holding means comprises a structure containing an opening, which is top opening 3. The structure comprises a plurality of sides surrounding top opening 3. Overlapping members 14 and 15 comprise one of a plurality of sides comprising the structure. The functional apparatus, or shaving aid 1, is held by securing means which comprises screw 6, which extends through an opening in one of a plurality of sides, and is operative to vary the amount of overlapping in overlapping members 14 and 15. Turning screw 6 enables the user to tighten or loosen the pressure of the structure around top opening 3 where the functional apparatus, or shaving aid 1, may be held.

Overlapping members 14 and overlapping members 15 are pressed together by the tightening of screw 6 and thereby cause the upper portion of shaving aid 1 to press against shaver 2 and secure it in the top opening 3 of shaving aid 1. The shaver 2 may be released from the shaving aid 1 by unscrewing screw 6 and thereby releasing the pressure of the shaver 2 and allowing it to be removed from shaving aid 1.

Shaving aid 1 further comprises a center section which contains a void 10 within two sides, one side having edges 8 and 9 and the other side having edge 7 and an edge not shown.

The stabilizing means may comprise an extended portion of the structure which is operative to be held between the legs of the user.

Shaving aid 1 may, therefore, be supported by a person between his legs. The four edges, 7, 8 and 9 and the one not shown, give greater stability to the holder of the shaving aid 1 by giving more pressure points and thereby a better grip so that the person holding the shaving aid 1 between his legs will be less likely to have it slip.

When the user holds the extended portion of the structure between his legs, one edge from each of the two sides will press against each leg of the user, providing greater stability for the device.

Figure 2:
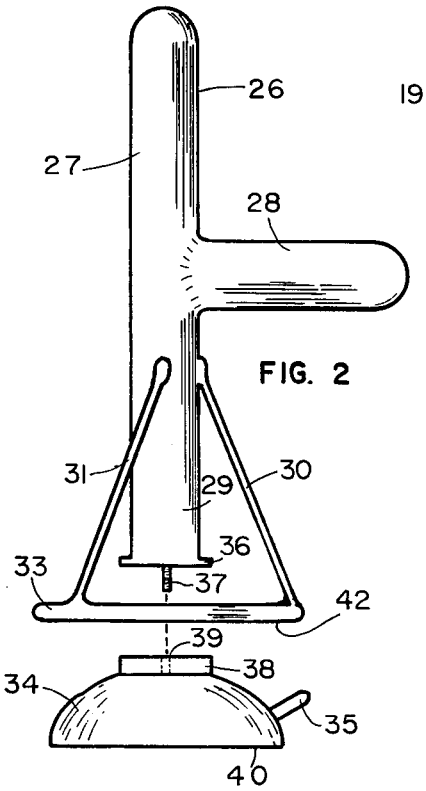
FIG. 2 is an exploded view of a functional apparatus support which is a shaving aid support 26.

FIG. 2 shows an exploded view of a functional apparatus support, shaving aid support 26. Vertical bar 27 and horizontal bar 28 on shaving aid support 26 are similar bars to those which can be found in a hospital as a bedrail or guardrail or on an I.V. stand.

The stabilizing means may also comprise support means operative to support the device and attaching means operative to attach the device to the support means. The support means may comprise suction means, operative to create a suction force on a surface, and bar means attached to the suction means.

The suction means may comprise suction cup 34, suction release tab 35, and suction cup top 38 containing threaded hole 39.

The support means may further comprise a ring stabilizer comprising stabilizing ring 33 and a plurality of stabilizing rods such as stabilizing rods 30, 31 and 32.

The bar means may comprise a vertical bar 27, a horizontal bar 28, permanently attached to vertical bar 27, and a support bar 29, which is the lower portion of the vertical bar 27 below horizontal bar 28.

The attaching means may comprise a base 23, an arcular piece 19, with an opening 18, emanating from base 23, and fastening means operative to fasten the support means within the opening of the arcular piece. The fastening means may be screw 17 extending through threaded hole 24 to press against the bar means in side opening 18. Any other fastening means would be within the scope of the invention. It is important that the fastening means hold the device securely.

The shaving aid 1 may be secured onto bars or rails similar to vertical bar 27 and horizontal bar 28 by use of fastening means such as screw 17. The bar like vertical bar 27 and horizontal bar 28 can be placed through opening 18 in shaving aid 1. The diameter of the bar used is slightly less than the distance between edge 20 and edge 21 of arcular piece 19. The concave surface 22 conforms to the circumference of the bar such as vertical bar 27 and horizontal bar 28. Arcular piece 19 has a strengthened base 23. Attaching screw 17 attaches through threaded hole 24 and presses against the bar which has been placed through opening 18. By use of attaching screw 17 and the strengthened base 23, the shaving aid 1 may be securely attached to the bar. By using opening 18, the shaving aid 1 may be attached to many different supports such as a bedrail, guardrail and an I.V. stand. By use of shaving aid support 26, the shaving aid 1 may be attached to many other surfaces including a mirror, a table, a wall, a desk, a dresser, a wheelchair or any flat surface.

Figure 3:
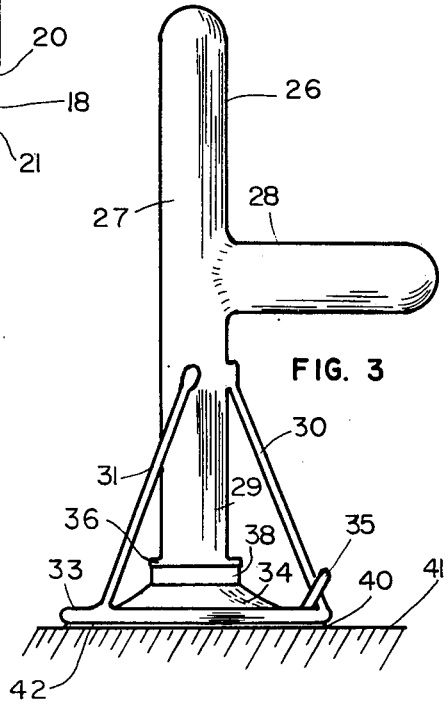
FIG. 3 is a view of shaving aid support 26 pressed on a flat surface.
Figure 4:
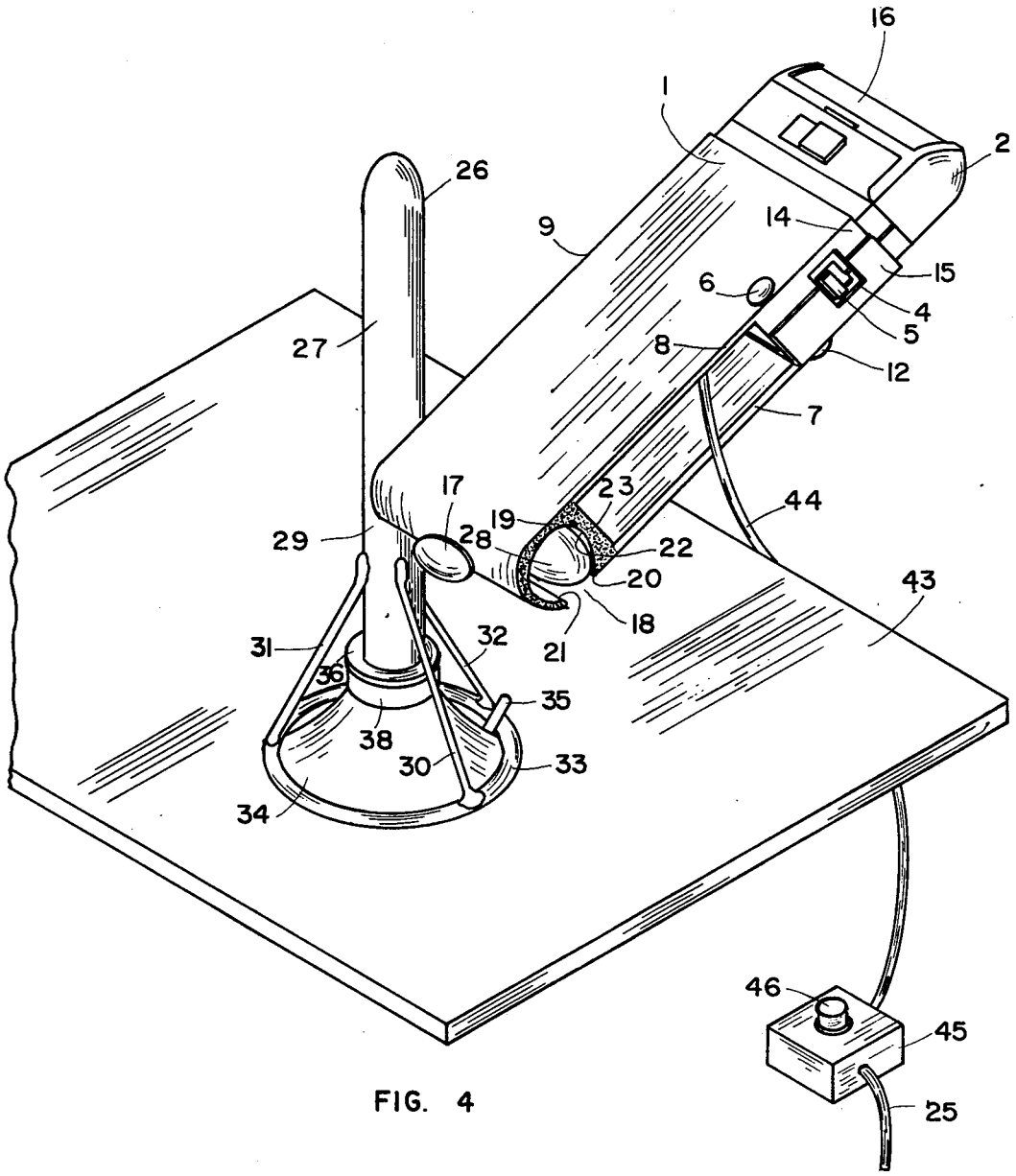
FIG. 4 is an isometric view of the shaving aid support 26 supporting shaving aid 1 on a table.

FIG. 3 shows a view of shaving aid support 26 pressed on a flat surface 41. Referring to FIGS. 2, 3 and 4, stabilizing rods 30, 31 and 32 are connected from support ring 33 to support bar 29, which is the lower portion of vertical bar 27.

Suction cup 34, with suction surface 40, is attached to support base 36 and screw 37 which is mounted in support base 36. Suction cup 34 has a suction release tab 35 to aid in releasing the suction when desired.

Screw 37 is secured in threaded hole 39 in suction cup top 38. Bottom surface 42 of support ring 33 acts to support whatever is attached to the shaving aid support 26, when the suction cup 34 is pressed onto a surface. The support ring 33 enables the shaving aid support 26 to be balanced and to solve any equilibrium problems with regard to any unit that is attached to the shaving aid support 26.

The clearance between the bottom surface 42 of support ring 33 and the suction surface 40 of the suction cup 34 is critical. The distance should be such that the entire suction surface is usable and that the bottom surface 42 of support ring 33 is close enough to the flat surface 41 in order to stabilize the unit.

It is recommended that Support Base 36 be the same diameter as suction cup top 38 in order to fully utilize the holding power of the suction cup 34.

FIG. 4 shows an isometric view of the shaving aid support 26 supporting shaving aid 1 on tabletop 43. FIG. 4 shows the shaving aid 1 secured to the horizontal bar 28 of shaving aid support 26.

Electrical cord 44 leads from shaver 2 to remote switch 45. Remote switch 45 contains an on-off button 46 so that the shaver 2 may be controlled without use of the hands. Electrical cord 25 leads from remote switch 45 to an electrical power source. The shaver 2 may, of course, be cordless or may not have the remote switch 45.

Shaving aid support 26 may be used not only as a shaving aid support, but as a universal support for many pieces of equipment which can be attached thereon. There are many devices which can utilize support 26 and/or shaving aid 1. For example, an electric toothbrush, massager, dryer or dispenser, or other devices could be inserted in top opening 3 of shaving aid 1, secured therein, and utilized in a similar manner as explained herein. Also, other devices could be utilized which could be attached to support 26, without using aid 1, to perform various desired functions.

The present invention can be utilized by a person who has limited or no use of his limbs. In the case of a man with no use of his arms or legs, the shaving aid and support can be set-up and turned on by a nurse. The man, if he can move his head, can still control the shaving functions.

If a man has partial use of a limb, such as his leg, the remote switch can be set-up so that he can turn the shaver on and off to shave at his own convenience. The man can also support the shaving aid between his legs.

The present invention can also be utilized by many other persons who might wish to support any device without the use of his limbs. Non-handicapped persons may wish to shave or perform other functions utilizing this invention.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

I claim:

1. A device for use with an apparatus comprising:

(a) holding means operative to hold said apparatus;

(b) stabilizing means operative to secure said holding means in a stable position, said stabilizing means comprising support means operative to support said device, and attaching means operative to attach said holding means to said support means; said attaching means comprising a base with a curved bottom; a single continuous arcular piece, with an opening, emanating from said base; and with a portion of said arcular piece being a continuation of said curved bottom of said base; and a void area between the end of said single continuous arcular piece and the bottom lip of said base through which said support means is placed within said opening, said curved bottom of said base continuing from said portion of said piece which is not said curved bottom of said base to said bottom lip of said base; and fastening means extending through said arcular piece, in the portion of said arcular piece which is not said curved bottom of said base, operative to press said support means against said curved bottom and said bottom lip of said base.

2. A device for use with an apparatus according to claim 1 wherein said holding means comprises a structure containing an opening within which said apparatus may be held.

3. A device according to claim 1 further comprising:

second stabilizing means operative to secure said holding means in a stable position, said second stabilizing means comprising an extended portion of said structure, said extended portion comprising two pieces connected between said holding means and a base, said two pieces comprising four edges which give stabilization to a user of said device while said device is placed between the legs of the user sitting in a normal sitting position.

4. A device for use with an apparatus according to claim 3 wherein said extended portion of said structure comprises two sides, each of said two sides having two edges, with a void between said two sides, whereby when said user holds said extended portion of said structure between the legs, one edge from each of said two sides will press against each leg of the user, providing greater stability for said device.

* * * * *